US007798045B1

(12) United States Patent
Fitzpatrick et al.

(10) Patent No.: US 7,798,045 B1
(45) Date of Patent: Sep. 21, 2010

(54) CHARGING HANDLE WITH FORWARD ASSIST FUNCTION

(75) Inventors: Richard M. Fitzpatrick, Longmont, CO (US); Michael Mayberry, Denver, CO (US); Brian Nakayama, Lakewood, CO (US); Eric Burt, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 380 days.

(21) Appl. No.: 12/013,406

(22) Filed: Jan. 11, 2008

Related U.S. Application Data

(60) Provisional application No. 60/884,615, filed on Jan. 11, 2007.

(51) Int. Cl.
*F41A 3/72* (2006.01)

(52) U.S. Cl. ..... 89/1.4; 89/191.01; 42/69.02

(58) Field of Classification Search ..... 89/1.4, 89/132, 138, 143, 191.01, 192, 179; 42/69.02, 42/14, 16
See application file for complete search history.

(56) References Cited

U.S. PATENT DOCUMENTS

| | | | | | |
|---|---|---|---|---|---|
| 2,845,001 | A * | 7/1958 | Hillberg | 89/1.4 |
| 3,225,653 | A * | 12/1965 | Packard | 89/1.4 |
| 4,827,652 | A * | 5/1989 | Martin | 42/142 |
| 6,311,603 | B1 * | 11/2001 | Dunlap | 89/1.4 |
| 7,131,228 | B2 * | 11/2006 | Hochstrate et al. | 42/75.01 |
| 7,231,861 | B1 * | 6/2007 | Gauny et al. | 89/1.4 |
| 7,240,600 | B1 * | 7/2007 | Bordson | 89/1.4 |
| D590,473 | S * | 4/2009 | Fitzpatrick et al. | D22/103 |
| D604,793 | S * | 11/2009 | Fitzpatrick et al. | D22/108 |
| D606,614 | S * | 12/2009 | Fitzpatrick et al. | D22/103 |
| 2005/0183310 | A1 * | 8/2005 | Finn | 42/49.01 |
| 2006/0156606 | A1 * | 7/2006 | Robinson et al. | 42/7 |
| 2009/0064556 | A1 * | 3/2009 | Fluhr et al. | 42/14 |
| 2010/0000396 | A1 * | 1/2010 | Brown | 89/1.4 |

* cited by examiner

*Primary Examiner*—Benjamin P. Lee
(74) *Attorney, Agent, or Firm*—Geoffrey E. Dobbin

(57) ABSTRACT

The present invention is an improved charging handle for a firearm. The handle is generally non-reciprocating and features a user activated forward assist. The major components are an actuator to provide charging function and upon which other components are mounted, a spring biased lever with a hook which biases downward so that the hook may interface a bolt carrier when the lever is activated, and a blade upon which handle structure is mounted. In the preferred embodiment, the handle is ambidextrous and features a spring detent to keep it in stowed position until the user desires use. The handle will only reciprocate when the lever is activated, which in turn requires intentional user action, thereby providing a relatively safer weapon to operate.

12 Claims, 8 Drawing Sheets

CHARGING HANDLE WITH FORWARD ASSIST FUNCTION

CROSS-REFERENCES TO RELATED APPLICATIONS

This Application claims priority as a non-provisional perfection of prior filed U.S. Provisional Application 60/884,615, filed on Jan. 11, 2007 and incorporates the same by reference in its entirety.

FIELD OF THE INVENTION

The present invention relates to the field of firearms and more particularly relates to a new charging handle for a firearm with a forward assist function.

BACKGROUND OF THE INVENTION

Prior firearms have been, as a whole, adequate for their purposes. However, the advent of improved technologies in other fields, combined with the demands of current military tactics, both offensive and defensive, have created a need for a firearm that improves upon the current designs in the art. Practically speaking, the need has arisen for a lighter and more efficient weapon; one that is easily maintained, simple to operate and assemble, and easily enhanced as need requires. This includes the various parts of the firearm, such as the charging handle.

The present invention is an improved charging handle for a firearm with a forward assist function. Forward assist allows for the user to have full control of the bolt carrier group in order to feed cartridges and push the bolt into battery if an obstruction or additional force is required. This can occur due to debris, fouling, a weakened action spring or magazines which require additional feeding force. Numerous improvements to the present invention make it simpler to operate and maintain as compared to the prior art. Specifically, the forward assist function given by the present invention is actionable along the entire length of the bolt carrier's path of travel and requires no special motions from the user, unlike forward assists used in the prior art.

SUMMARY OF THE INVENTION

This invention provides an improved charging handle for a firearm with increased utility. As such, the present invention's general purpose is to provide a new and improved charging handle with a forward assist function for greater control of the firing bolt group within the firearm.

Most rifle firearms, as used in the military, comprise four major components, the upper and lower receivers, the stock and the barrel. Operable parts are contained within the upper and lower receivers. The lower receiver usually contains the trigger assembly, a bolt catch, hammer and sear. It also presents the magazine well and structure and a safety structure. The upper receiver contains the bolt assembly, a gas piston system recoil system, charging assembly, mounting structure for the barrel and the firing chamber. The stock is usually attached to one or both the upper and lower receivers.

The charging system according to the present invention comprises a charging actuator, upon which additional components reside, a charging blade with two charging knobs for user interface, a spring loaded forward assist lever to selectively engage the bolt carrier, and a detent spring to interface with firearm geometry and keep the actuator in a stowed position when not in use.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the firearm is herein described. It should be noted that the articles "a", "an" and "the", as used in this specification, include plural referents unless the content clearly dictates otherwise.

Figure 1:
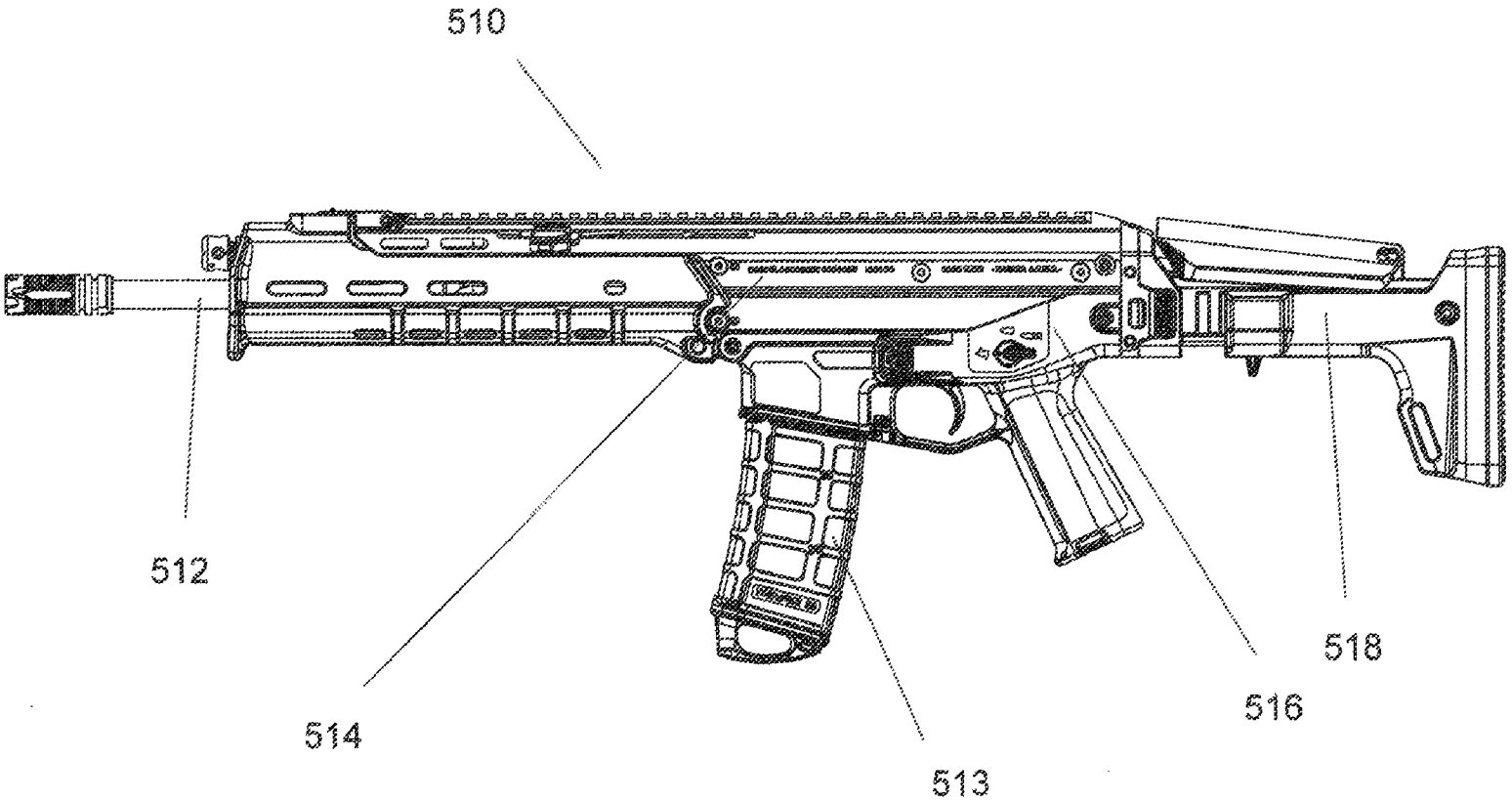
FIG. 1 is a left plan view of the firearm using the charging system according to the present invention.
Figure 2:
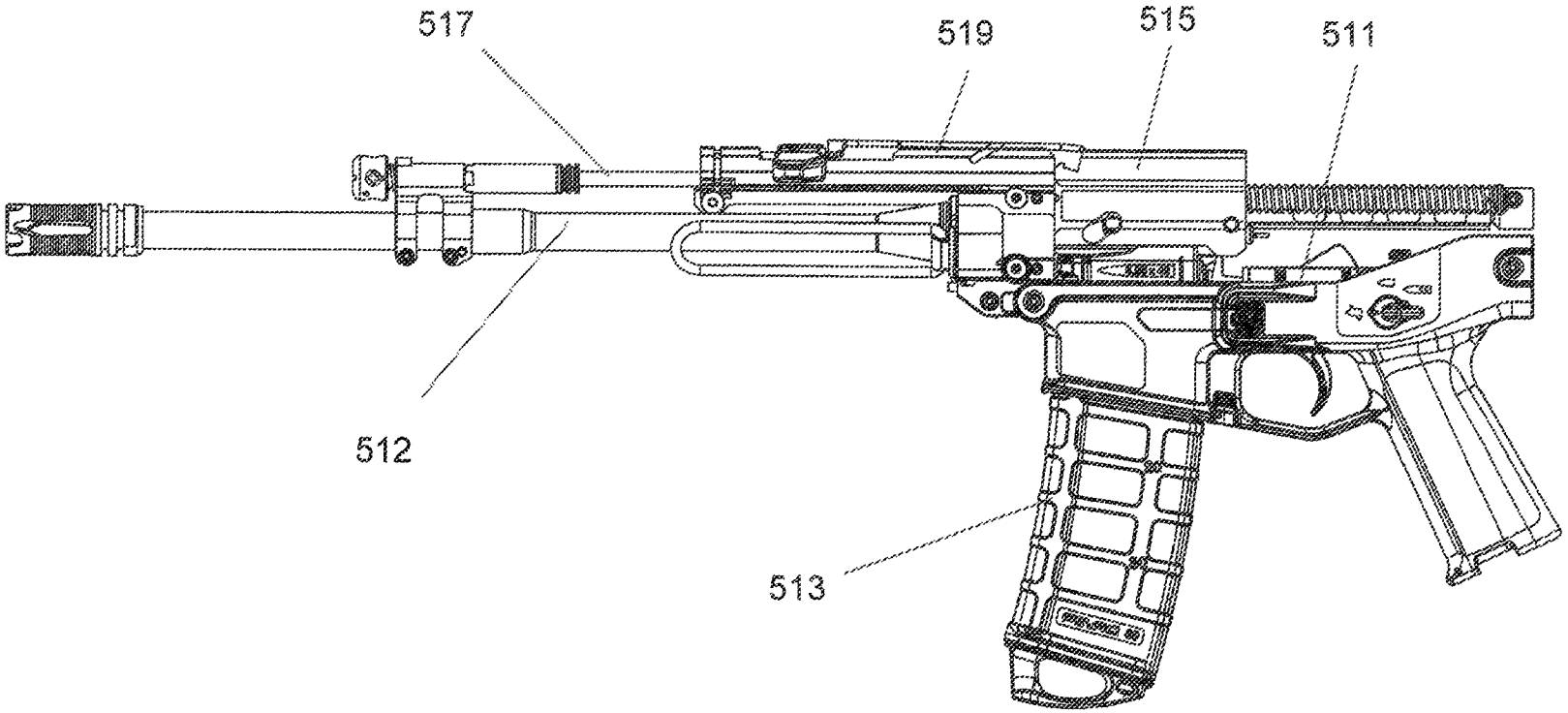
FIG. 2 is a view of the firearm of FIG. 1, partially disassembled.
Figure 3:
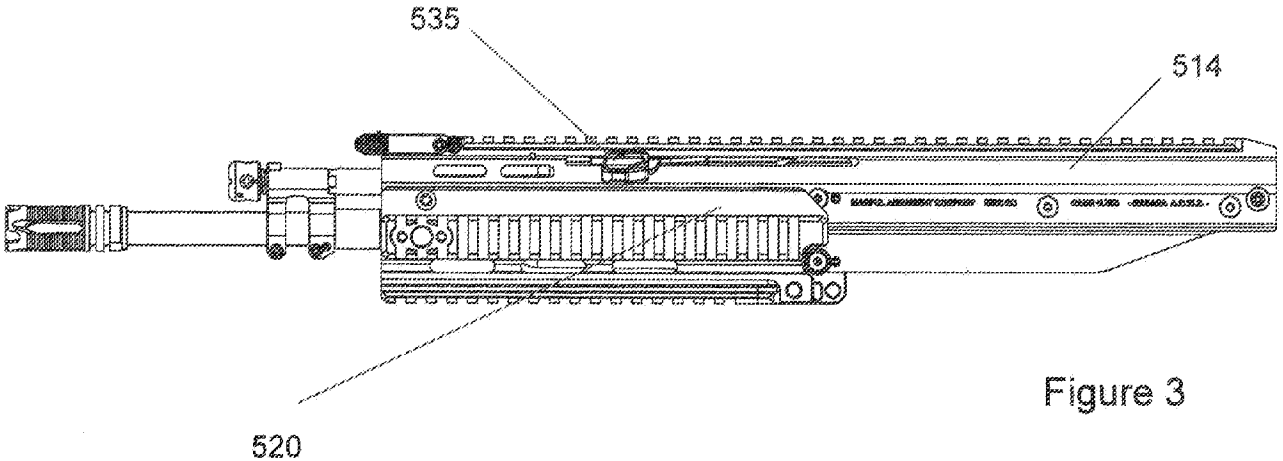
FIG. 3 is a left plan view of the receiver and receiver stored components of the firearm of FIG. 1.
Figure 4:
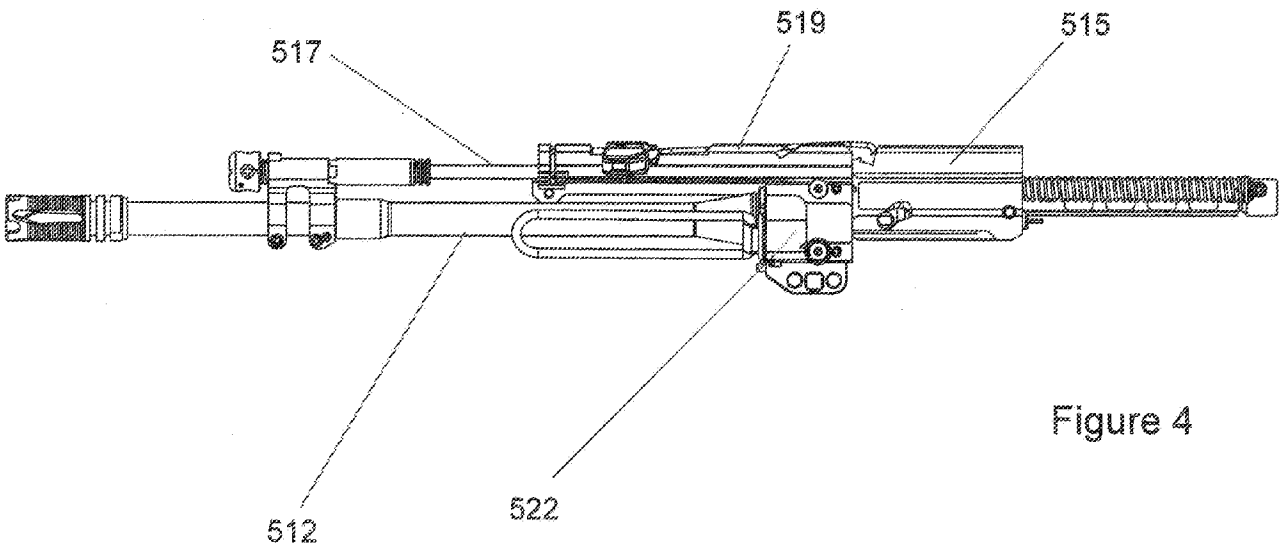
FIG. 4 is a left plan view of the receiver stored components of the firearm of FIG. 1.
Figure 6:
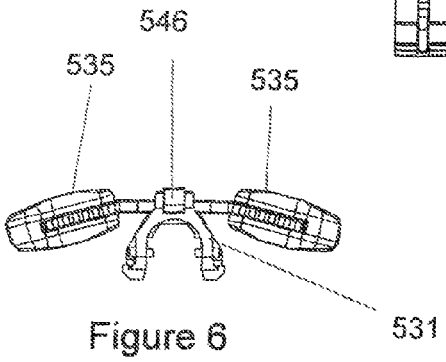
FIG. 6 is a front plan view of the charging apparatus of FIG. 5

With reference to FIGS. 1 and 2, the firearm 510 has four major components, namely the barrel 512, upper receiver 514, grip housing 516 and stock 518. Internal parts are generally located in the receiver 514 and grip housing 516. A trigger control group 511 and a magazine 513 reside in the grip housing 516 and a short stroke gas piston system 517 and charging system 519 and bolt carrier 515 reside in the receiver 514. The firing pin is also located in the receiver 514. As shown in FIG. 4, barrel 512 rests in barrel trunnion 522 in a cantilevered fashion. Gas piston system 517 resides over the barrel 512. Bolt carrier 515 rests against the barrel trunnion 522 when it is in a rest position. The charging handle 519 resides over the barrel trunnion 522, also abutting the bolt carrier 515, and mounted upon firearm geometry so as to allow movement transverse the barrel 512 and the path of the bolt carrier 515. When stowed, the charging knobs 535 extend beyond the receiver 514 and above the hand guard 520 of the firearm (FIG. 3) on both sides so as to allow ambidextrous use without alteration.

The charging handle system itself, shown in FIGS. 5-8*a* and 13, is a non-reciprocating design, which is to say that is usually does not travel with the bolt carrier when the firearm is fired. The charging handle group 519 consists of a charging handle actuator 531, charging handle blade 537, and forward assist lever 533. Charging handle blade 537 resides at a fore end of charging handle actuator 531 and provides support for the charging handle knobs 535, which are secured by pins 536.

Figure 5:
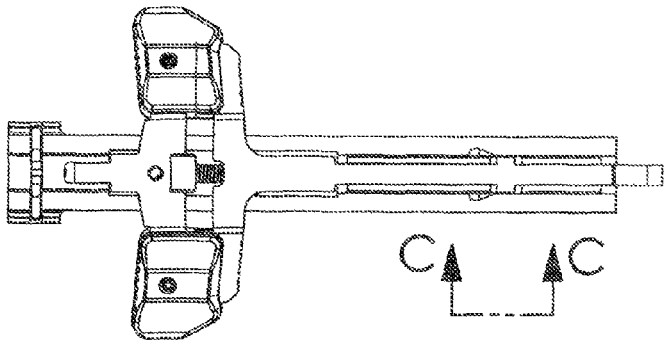
FIG. 5 is a top plan view of the charging apparatus according to the present invention.
Figure 5A:
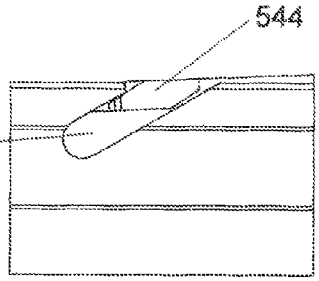
FIG. 5*a* is a close-up left plan view taken between lines C-C in FIG. 5.

Forward assist lever 533 resides at a distal end of charging handle actuator 531 between two ridges 540, slightly above the surface of the charging handle actuator 531. Angled slot 542 cuts towards the fore end of the charging handle actuator 531 and through ridges 540. The forward assist lever 533 has two ears 544 which reside in the slot 542. Forward assist lever 533 is biased rearward by spring 539 residing between forward assist lever 533 and spring block 538. Ears 544 have an angular orientation (seen in FIGS. 5*a* and 8*a*) that keep them positioned within the slot 542 and allows for fluid motion of the ears downward as the forward assist lever 533 is pushed forward against spring 539. Forward assist lever 533 is provided with a hook 546 that extends off of distal end of the charging handle actuator 531. Forward assist lever 533 is further secured in the system by a T-bar 533*a* which, when assembled, resides in two slots 535*a* fashioned in the charging knobs 535.

Figure 9:
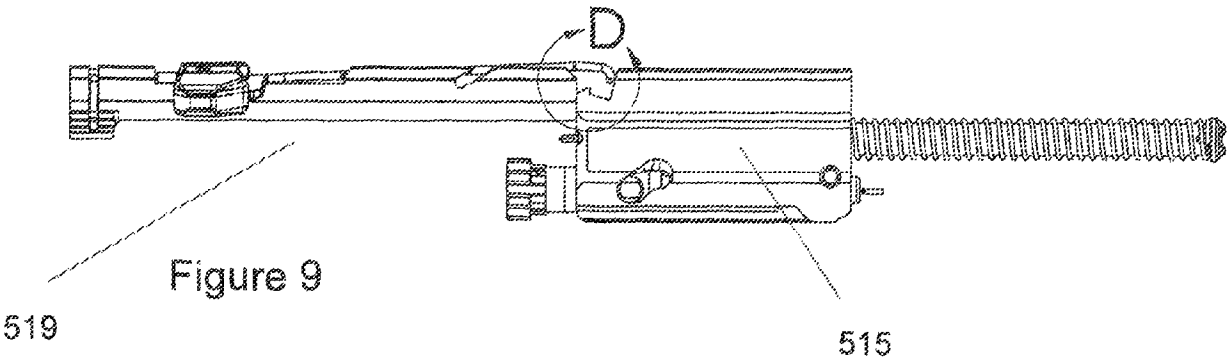
FIG. 9 is a left plan view of the charging apparatus and bolt carrier group of the firearm of FIG. 1, in non-reciprocal relationship.
Figure 9A:
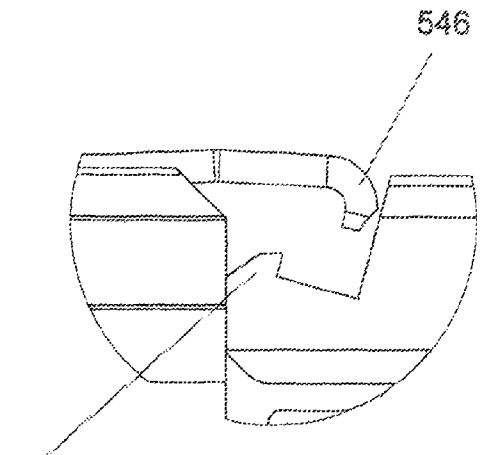
FIG. 9*a* is a close-up view, taken in circle D of FIG. 9.
Figure 10:
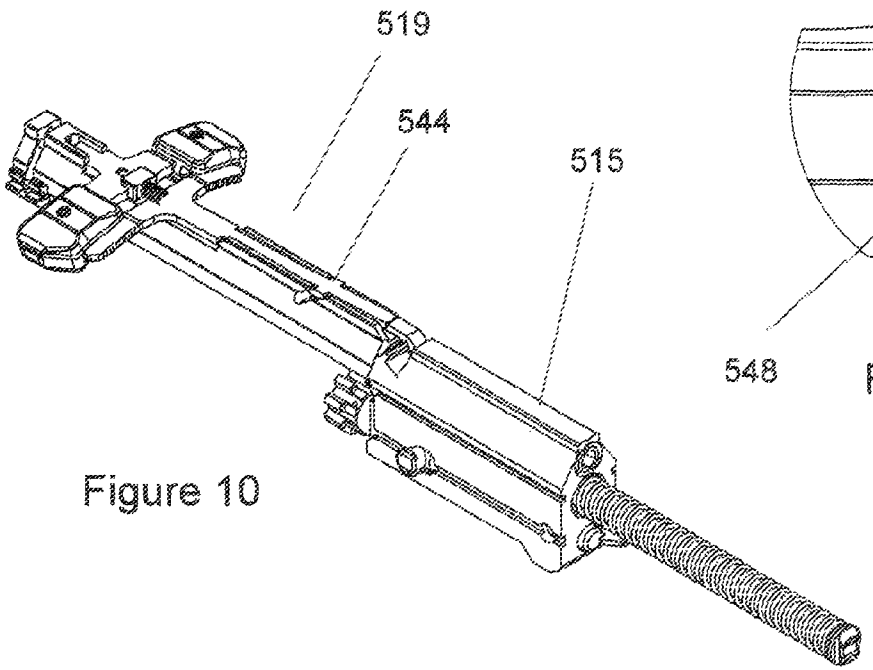
FIG. 10 is a perspective view of the charging system and bolt carrier group of FIG. 9.
Figure 11:
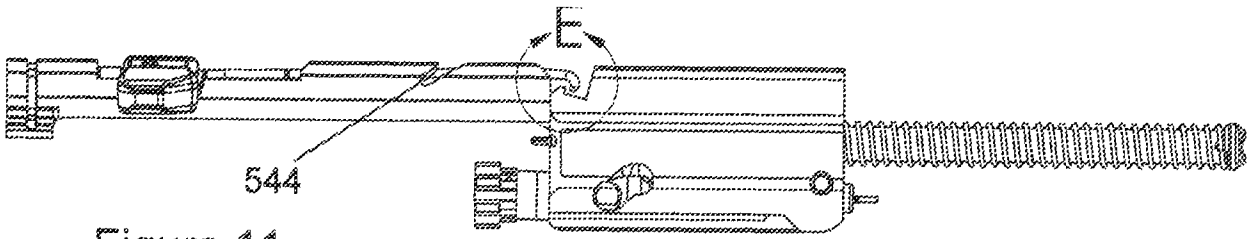
FIG. 11 is a left plan view of the charging apparatus and bolt carrier group of the firearm of FIG. 1, in a reciprocal relationship.
Figure 11A:
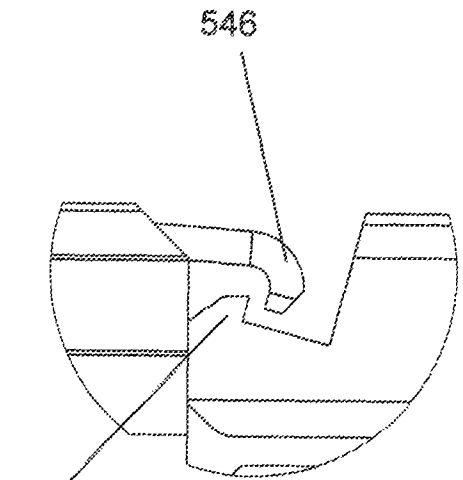
FIG. 11*a* is a close-up view, taken in circle E of FIG. 11.
Figure 12:
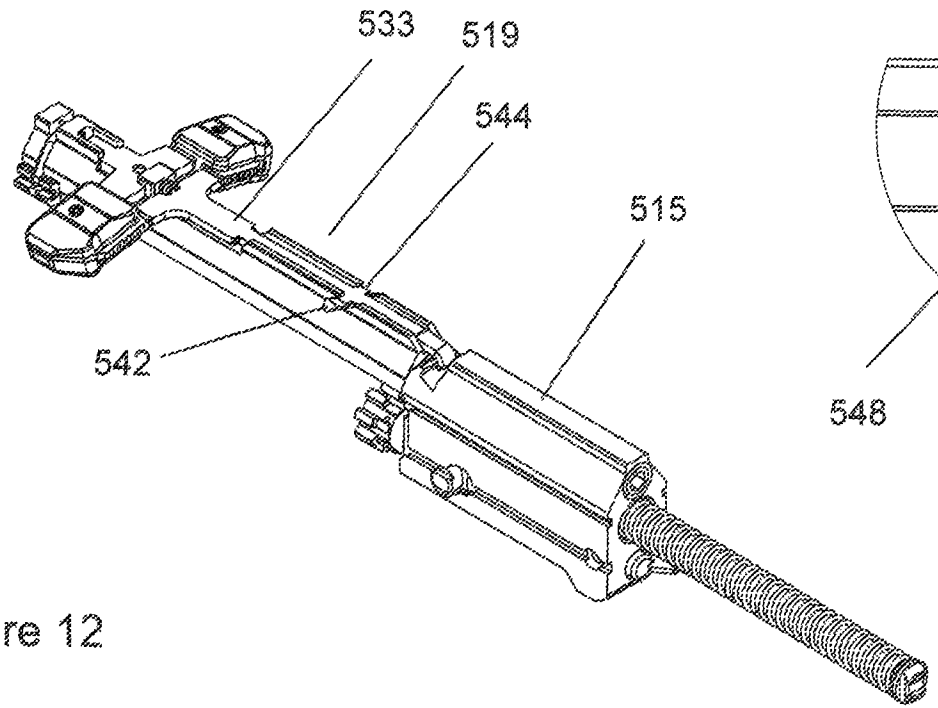
FIG. 12 is a perspective view of the charging system and bolt carrier group of FIG. 11.
Figure 13:
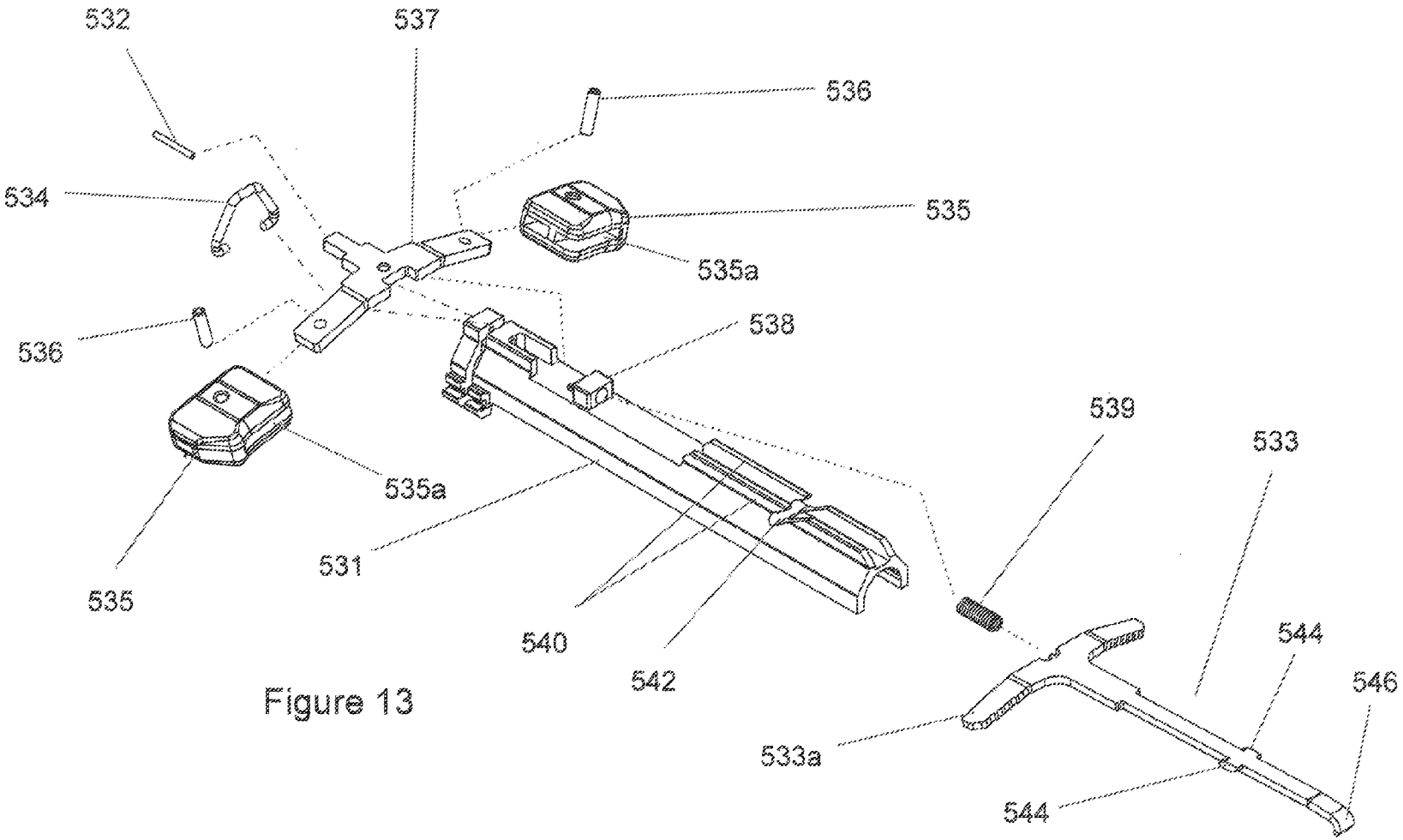
FIG. 13 is an exploded view of the charging system of the present invention.

When in default, non-reciprocating, position, shown in FIGS. 9-10, the charging handle 519 abuts bolt carrier 515. Should charging handle 519 be pulled back in relation to the firearm, it will push bolt carrier 515 along its path and charge the system. In this position, the charging handle 519 will not travel with the bolt carrier 515 when the firearm is fired as the two are not connected. As can be seen in FIG. 9*a*, the hook 546 is positioned above a ridge 548 in a notch (not numbered) in the bolt carrier 515. When the forward assist lever is pressed forward, shown in FIGS. 11-12, ears 544 travel along the slot 542 and bias the forward assist lever 531 and hook 546 downward. The hook 546 then engages the ridge 548 (FIG. 11*a*), linking the bolt carrier 515 to the charging handle 519. This then allows the charging handle 519 to pull the bolt carrier 515 and act as a forward assist to move the bolt carrier 515 back into firing position. Since the forward assist lever 533 is spring biased backwards, releasing the forward assist lever allows the hook 546 to automatically release the ridge 548, uncoupling the charging handle 519 and bolt carrier 515.

Figure 7:
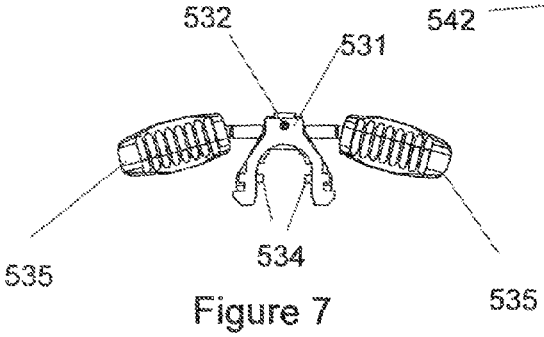
FIG. 7 is a rear plan view of the charging apparatus of FIG. 5
Figure 8:
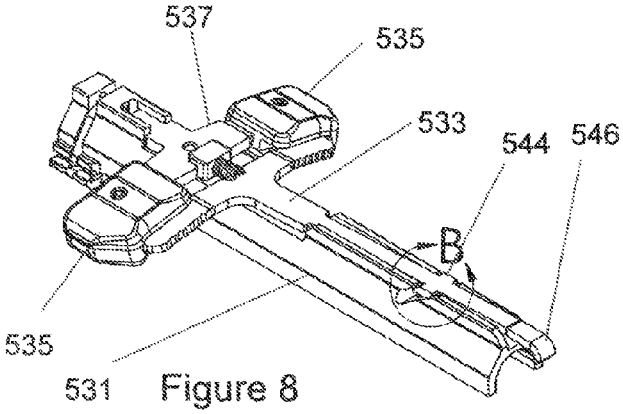
FIG. 8 is a perspective view of the apparatus of FIG. 5.
Figure 8A:
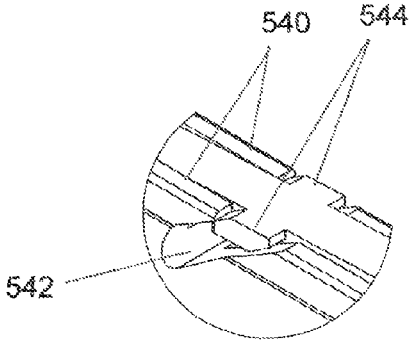
FIG. 8*a* is a close up view taken in circle B of FIG. 8.
Figure 14:
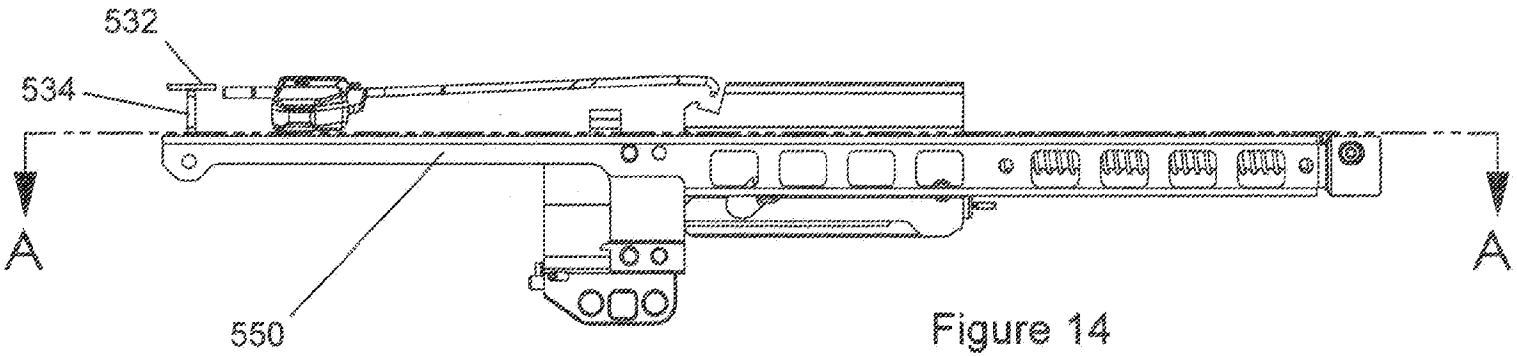
FIG. 14 is a left plan view of the charging system and it's mounting components, with the charging handle actuator removed.
Figure 15:
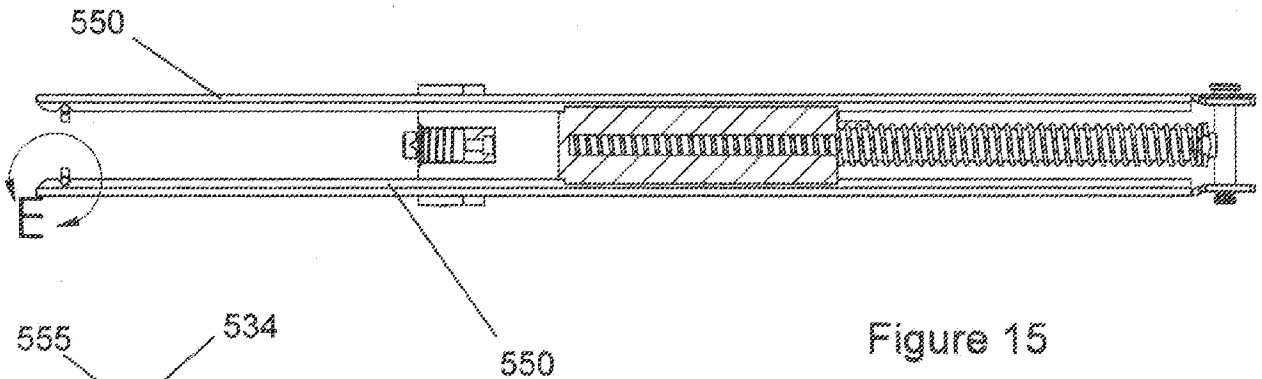
FIG. 15 is a sectional view of the system of FIG. 14, taken along line A-A
Figure 15A:
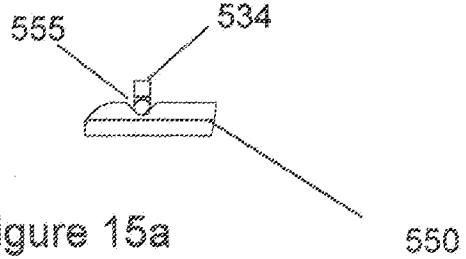

In its preferred embodiment, the charging handle system 519 is mounted to the firearm on two rails 550 which reside along the path of travel of the charging handle 519 and the bolt carrier 515 (FIGS. 14-15*a*). FIG. 14 depicts the system with the charging handle actuator removed. A detent spring 534 is provided in the fore end of the actuator 531 (shown in FIGS. 7 and 13). It is secured by pin 532. As can be seen in FIG. 7, ends of the detent spring 534 extend underneath and inward of the charging handle actuator 531. These ends interface with notches 555 provided in the rails 550 (FIG. 15*a*) to secure the charging handle 519 in its forward position in relation to the firearm, until removed from this position by a user.

The invention has been described with reference to preferred embodiments, numerous modifications and variations can be made and still the result will come within the scope of the invention. No limitation with respect to the specific embodiments disclosed herein is intended or should be inferred.

What is claimed is:

1. A charging handle for a firearm comprising:

a. A charging handle actuator having a diagonal notch on a dorsal side, said notch extending downward and towards a fore end of the actuator;

b. A spring biased forward assist lever, residing on the dorsal side of the charging handle actuator and further comprising:

i. a fore end capable of manipulation against the spring bias;

ii. angled ears residing in the notch; and iii. a hook residing aft of a distal end of the actuator; and c. a charging handle blade residing on the dorsal side and towards the fore end of the charging handle actuator, said charging handle blade providing support for at least one user interface knob, wherein, when the fore end of the forward assist lever is manipulated against the spring bias, the forward assist lever moves forward and the ears, and correspondingly the hook, are biased downward, allowing the hook to interface with a bolt carrier.

2. The charging handle of claim 1, further comprising a detent spring designed to interface with at least one detent notch located on support rails for the charging handle within the firearm.

3. The charging handle of claim 2, the charging handle actuator further comprising lateral retention means for the forward assist lever.

4. The charging handle of claim 3, the lateral retention means being a pair of ridges between which the forward assist lever resides, the detent notch extending though said ridges.

5. The charging handle of claim 1, the charging handle actuator further comprising lateral retention means for the forward assist lever.

6. The charging handle of claim 5, the lateral retention means being a pair of ridges between which the forward assist lever resides, the detent notch extending though said ridges.

7. The charging handle of claim 1, the fore end of the forward assist lever being T shaped, with each side of said T interfacing with one user interface knob and extending out from a left and right side of the charging handle, thereby providing ambidextrous use of the charging handle.

8. The charging handle of claim 7, further comprising a detent spring designed to interface with at least one detent notch located on support rails for the charging handle within the firearm.

9. The charging handle of claim 8, the charging handle actuator further comprising lateral retention means for the forward assist lever.

10. The charging handle of claim 9, the lateral retention means being a pair of ridges between which the forward assist lever resides, the detent notch extending though said ridges.

11. The charging handle of claim 7, the charging handle actuator further comprising lateral retention means for the forward assist lever.

12. The charging handle of claim 11, the lateral retention means being a pair of ridges between which the forward assist lever resides, the detent notch extending though said ridges.

* * * * *